US012357087B2

(12) United States Patent
Kim

(10) Patent No.: US 12,357,087 B2
(45) Date of Patent: Jul. 15, 2025

(54) PORTABLE BOOKSTAND

(71) Applicant: Myeonghyeon Kim, Seongnam-si (KR)

(72) Inventor: Myeonghyeon Kim, Seongnam-si (KR)

( * ) Notice: Subject to any disclaimer, the term of this patent is extended or adjusted under 35 U.S.C. 154(b) by 0 days.

(21) Appl. No.: 18/561,333

(22) PCT Filed: May 11, 2022

(86) PCT No.: PCT/KR2022/006772
§ 371 (c)(1),
(2) Date: Nov. 16, 2023

(87) PCT Pub. No.: WO2022/245041
PCT Pub. Date: Nov. 24, 2022

(65) Prior Publication Data

US 2024/0251939 A1 Aug. 1, 2024

(30) Foreign Application Priority Data

May 17, 2021 (KR) ..... 10-2021-0063528

(51) Int. Cl.
*A47B 23/04* (2006.01)

(52) U.S. Cl.
CPC ..... *A47B 23/044* (2013.01); *A47B 23/042* (2013.01); *A47B 23/043* (2013.01); *A47B 2023/045* (2013.01); *A47B 2220/0016* (2013.01)

(58) Field of Classification Search
CPC ..... A47B 2023/045; A47B 2023/044; A47B 2003/004; A47B 23/042; A47B 23/06;
(Continued)

(56) References Cited

U.S. PATENT DOCUMENTS 115,886 A * 6/1871 North ..... A47B 23/042 248/452
269,683 A * 12/1882 Koehl ..... A47B 23/042 40/352

(Continued)

FOREIGN PATENT DOCUMENTS

FR 1496517 A * 9/1967 ..... A47B 23/043
GB 281469 A * 12/1927

(Continued)

OTHER PUBLICATIONS

Machine translation of JP 2003325237 (Year: 2003).*
International Search Report dated Sep. 1, 2022 in International Application No. PCT/KR2022/006772.

*Primary Examiner* — Taylor Morris
(74) *Attorney, Agent, or Firm* — Saliwanchik, Lloyd & Eisenschenk

(57) ABSTRACT

The present invention relates to a portable bookstand, in particular, to a portable bookstand which is easy to carry due to having a foldable structure, firmly supports a book, and prevents pages from flipping arbitrarily, the portable bookstand comprising: a book back support frame which supports the back of a book; a first page fixing frame which is rotatably coupled to one side of the book back support frame and fixes the page while supporting one side of the book; and a second page fixing frame which is rotatably coupled to the other side of the book back support frame and fixes the page while supporting the other side of the book, wherein the book back support frame, the first page fixing frame, and the second page fixing frame are formed by bending wires, and the book back support frame includes a truss structure formed in an X-shape and is coupled to each of the first page fixing frame and the second page fixing frame that are arranged so that the upper ends forming truss structures face frontward.

5 Claims, 9 Drawing Sheets

(58) Field of Classification Search
CPC ..... A47B 23/044; A47B 23/043; G09F 1/10; B42D 3/126; B42D 3/16
USPC ..... 248/173, 175, 465.1; D6/313; D19/91
See application file for complete search history.

(56) References Cited

U.S. PATENT DOCUMENTS 365,999 A * 7/1887 Hogberg ..... A47C 3/00 297/447.4
870,914 A * 11/1907 Twitchell ..... A47B 23/042 248/448
1,033,660 A * 7/1912 Beecher ..... A47B 23/042 248/452
1,268,946 A * 6/1918 Harris ..... A47B 23/042 248/448
1,289,644 A * 12/1918 Burnett ..... A47B 5/02 248/465.1
1,384,757 A * 7/1921 Harrison ..... G09F 1/10 248/490
1,544,724 A * 7/1925 Chalmers ..... A47B 23/043 248/465.1
1,713,667 A * 5/1929 Leng ..... A47F 5/13 211/85
1,840,620 A * 1/1932 Dennis ..... A47B 23/043 248/462
1,938,528 A * 12/1933 Marseglia ..... A47B 23/043 248/444
2,043,304 A * 6/1936 Pfister ..... A47B 23/044 248/464
2,081,602 A * 5/1937 Rubenstein ..... A47F 5/01 211/181.1
2,186,883 A * 1/1940 Robinson ..... A47F 5/13 211/181.1
2,195,777 A * 4/1940 Greicius ..... A47B 23/043 40/357
2,278,568 A * 4/1942 Segre ..... A47C 4/32 248/436
2,441,932 A * 5/1948 Curry ..... A47B 23/044 248/460
2,965,159 A * 12/1960 Fridolph ..... A47C 7/282 211/198
2,971,286 A * 2/1961 Ernst ..... A47B 19/08 248/464
3,007,278 A * 11/1961 Million ..... A47B 23/044 D19/91
3,193,240 A * 7/1965 Browett ..... A47B 23/043 248/449
3,376,009 A * 4/1968 Domino ..... A47B 23/043 248/456
3,595,509 A * 7/1971 Gilmoure ..... G09F 1/10 248/175
3,945,598 A * 3/1976 Bell ..... A47B 23/042 D19/91
4,060,216 A * 11/1977 Million ..... A47B 23/044 248/447
4,117,936 A * 10/1978 Dawson ..... A47F 7/148 248/460
4,118,065 A * 10/1978 Watkins ..... A47C 4/286 280/42
4,569,447 A * 2/1986 Cifranic ..... A47B 65/00 248/302
5,165,722 A * 11/1992 Wong ..... B42D 9/00 24/679
5,826,837 A * 10/1998 Moineau ..... B65B 67/1205 248/153
7,490,798 B2 * 2/2009 Mann ..... A47G 23/0241 141/319
7,726,622 B2 * 6/2010 Weder ..... A01G 5/04 248/168
9,625,081 B2 * 4/2017 Olander ..... A47B 97/08
2003/0001065 A1 1/2003 Ng
2004/0173725 A1 * 9/2004 Rodriguez Villanueva ..... A47B 23/042 248/454

FOREIGN PATENT DOCUMENTS

GB 434504 A * 9/1935
GB 888058 A * 1/1962
JP 2003325237 A * 11/2003 ..... A47B 23/00
JP 2007-68629 A 3/2007
KR 88-228 U 2/1988
KR 89-2055 U 3/1989
KR 900005281 Y1 * 6/1990 ..... A47B 23/007
KR 10-2010-0001099 A 1/2010
KR 20100001099 A * 1/2010 ..... A47B 23/043
KR 20120006352 U * 9/2012 ..... A47B 23/043
KR 20160130555 A * 1/2013 ..... A47B 23/043
KR 200476202 Y1 * 2/2015 ..... A47B 23/06
WO WO-2008080207 A1 * 7/2008 ..... A47B 23/043

* cited by examiner

PORTABLE BOOKSTAND

CROSS-REFERENCE TO RELATED APPLICATIONS

This application is the U.S. national stage application of International Patent Application No. PCT/KR2022/006772, filed May 11, 2022, which claims the benefit under 35 U.S.C. § 119 of Korean Application No. 10-2021-0063528, filed May 17, 2021, the disclosures of each of which are incorporated herein by reference in their entirety.

TECHNICAL FIELD

The present disclosure relates to a portable bookstand, and particularly to a portable bookstand which is easy to carry due to a foldable structure thereof and can securely support a book.

BACKGROUND ART

Generally, a bookstand is a product developed to eliminate the inconvenience that a user must continuously hold the book with his or her hand while reading. The bookstand supports the book at a predetermined angle so that the user can read comfortably without putting strain on the arm.

As illustrated in FIG. 1, a normal bookstand 10 includes a book seat part 1 on which a book is seated, a book support 11 against which the book seated on the book seat part 1 leans, an inclination support means 15 provided on the back of the book support 11 to support the book support 11 by adjusting the angle of the book support 11, and page fixing parts 13 made of elastic material that are hinged to the lower side of the book support 11 and fix pages of the book leaning against the book support 11.

The book support 11 can be folded so that the book support 11 is adjacent to the entirety of the inclination support means 15, but the bookstand 10 is large and heavy overall and thus is not suitable for carrying around and using.

Accordingly, there are a variety of portable bookstands on the market that are smaller and lighter and have more improved portability than the bookstand 10 illustrated in FIG. 1. However, the portable bookstands do not securely support a book and fall over along with the book, or do not fix pages of the book, so there is a problem that although the portable bookstands are used, a user is required to hold the pages of the book with his or her hand.

DISCLOSURE

Technical Problem

The present disclosure has been made to solve the above problems, and is intended to propose a portable bookstand which is easy to carry due to a foldable structure thereof, securely supports a book, and inhibits pages of the book from flipping arbitrarily.

Technical Solution

In order to accomplish the above objectives, a portable bookstand of the present disclosure includes: a book back support frame configured to support a back of a book; a first page fixing frame coupled rotatably to a first side of the book back support frame and configured to fix a page of the book while supporting a first side of the book; and a second page fixing frame coupled rotatably to a second side of the book back support frame and configured to fix a page of the book while supporting a second side of the book, wherein the book back support frame, the first page fixing frame, and the second page fixing frame are formed by bending wires, and the book back support frame comprises an 'X'-shaped truss structure, with upper ends of the truss structure being respectively coupled to the first page fixing frame and the second page fixing frame disposed to face forward.

In addition, the book back support frame may include: a supporting wire configured to support the back of a book, a first coupling wire formed by extending downward from a first end of the supporting wire, with the first page fixing frame being coupled to the first coupling wire, a second coupling wire formed by extending downward from a second end of the supporting wire, with the second page fixing frame being coupled to the second coupling wire, a first support wire formed by extending from a lower end of the first coupling wire toward the second page fixing frame, with an upper end of the first support wire being removably coupled to the second page fixing frame, and a second support wire formed by extending from a lower end of the second coupling wire toward the first page fixing frame, with an upper end of the second support wire being removably coupled to the first page fixing frame.

In addition, the opposite ends of the supporting wire may bend to protrude by predetermined lengths forward, and a lower end of the first support wire and a lower end of the second support wire may bend to protrude by predetermined lengths rearward from the lower end of the first coupling wire and the lower end of the second coupling wire, respectively.

In addition, the book back support frame, the first page fixing frame, and the second page fixing frame may be formed of elastic wires, and the upper end of the first support wire and the upper end of the second support wire may be respectively removed from the second page fixing frame and the first page fixing frame to be located on rears of the second coupling wire and the first coupling wire, and the first page fixing frame and the second page fixing frame may be folded inward so that outermost parts of the first page fixing frame and the second page fixing frame adjacent to the second coupling wire and the first coupling wire, respectively, may be held to be located on the rears of the second coupling wire and the first coupling wire, respectively. In addition, the supporting wire may be formed to be concave downward.

Advantageous Effects

According to the present disclosure, the book back support frame, the first page fixing frame, and the second page fixing frame are formed by bending wires, so the portable bookstand of the present disclosure is significantly lighter than a conventional bookstand. Furthermore, the portable bookstand of the present disclosure can be small since the first page fixing frame and the second page fixing frame can be folded to be located inside the book back support frame, so the portable bookstand can be placed between pages of a book or in a book pouch with the book, thereby making it easy to carry the bookstand.

In addition, during the use of the portable bookstand of the present disclosure, while the first page fixing frame and the second page fixing frame face forward, the 'X'-shaped truss structure of the book back support frame securely supports a book, and at the same time, the first page fixing frame and the second page fixing frame inhibit pages of the book from flipping arbitrarily, thereby allowing a user to read the book while the book is stably mounted.

BEST MODE

Figure 1:
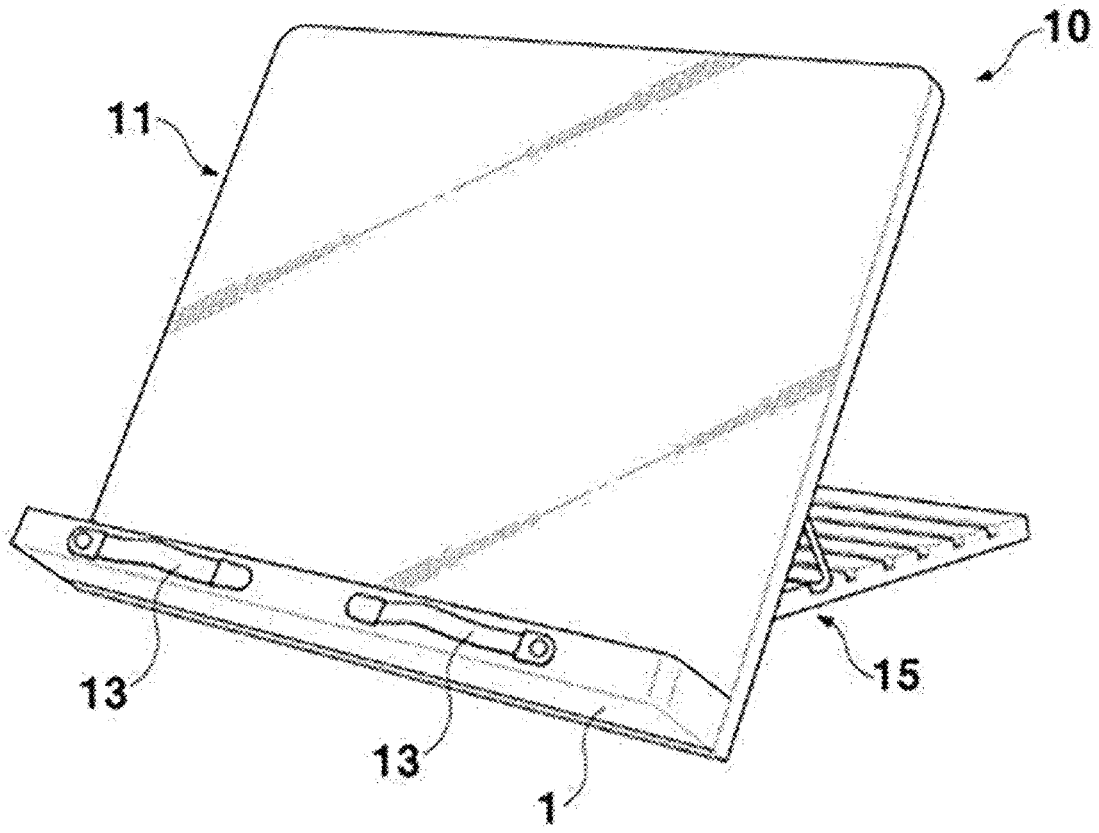
FIG. 1 is a perspective view illustrating the structure of a conventional bookstand.

The present disclosure provides a portable bookstand which is easy to carry due to a foldable structure thereof, securely supports a book, and prevents inhibits pages of the book from flipping arbitrarily, and the portable bookstand includes: a book back support frame configured to support the back of a book; a first page fixing frame coupled rotatably to a first side of the book back support frame and configured to fix a page of the book while supporting a first side of the book; and a second page fixing frame coupled rotatably to a second side of the book back support frame and configured to fix a page of the book while supporting a second side of the book, wherein the book back support frame, the first page fixing frame, and the second page fixing frame are formed by bending wires, and the book back support frame includes an 'X'-shaped truss structure, with upper ends of the truss structure being respectively coupled to the first page fixing frame and the second page fixing frame disposed to face forward.

The scope of claims of the present disclosure is not limited to an embodiment described below, and the embodiment may be variously modified by those skilled in the art within the scope of the technical gist of the present disclosure.

As illustrated in FIGS. 2 to 6, the portable bookstand of the present disclosure includes the book back support frame 100, which supports the back of a book, which is a side visible when the book is placed on a bookshelf, and the first page fixing frame 200 and the second page fixing frame 300, which support an open book and fix pages of the book.

According to the present disclosure, the book back support frame 100, the first page fixing frame 200, and the second page fixing frame 300 are by bending wires, so the portable bookstand of the present disclosure is significantly lighter than a conventional bookstand made of wood. Each of the book back support frame 100, the first page fixing frame 200, and the second page fixing frame 300 may be formed by bending one piece of wire. In addition, each of the first page fixing frame 200 and the second page fixing frame 300 may be formed to have the same shape by bending one piece of wire, thereby reducing manufacturing costs and increasing manufacturing convenience. Accordingly, the first page fixing frame 200 and the second page fixing frame 300 may have ring-shaped ends thereof wound in the same directions.

Wires used to form the book back support frame 100, the first page fixing frame 200, and the second page fixing frame 300 of the present disclosure are preferably elastic wires. As a result, the wires can elastically support the weight of a mounted book, and when folded, the portable bookstand can have minimal volume.

The book back support frame 100 is coupled to the first page fixing frame 200 and the second page fixing frame 300, and stands on the ground to support books according to an angle to the first page fixing frame 200 and the second page fixing frame 300. In this case, the book back support frame 100 may be erected perpendicular to the ground, but it is preferable that the upper end of the book back support frame 100 is tilted by approximately 10 to 20 degrees forward relative to a lower end thereof so as to inhibit the portable bookstand of the present disclosure from falling rearward due to the weight of a mounted book and to support the back of the book more securely.

Figure 4:
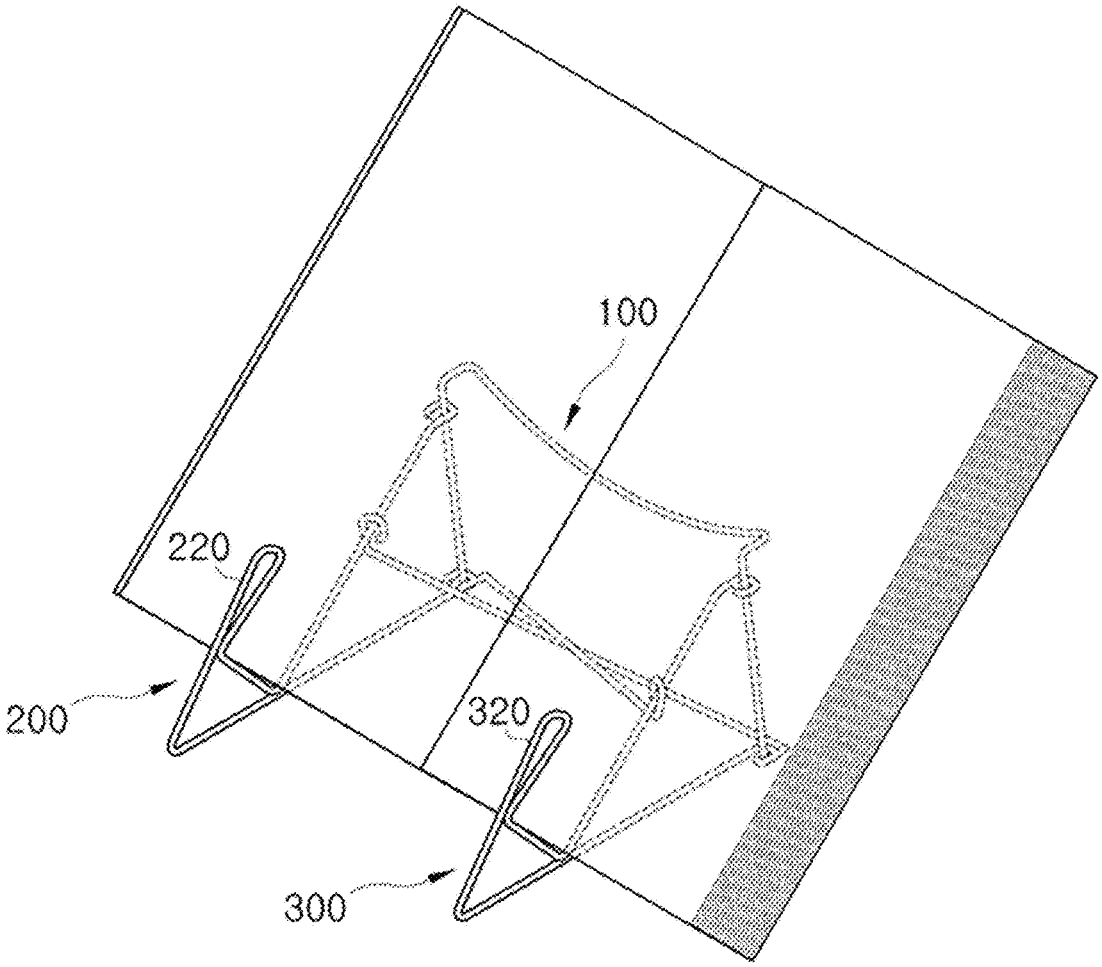
FIG. 4 is an example view illustrating a state in which a book is mounted on the portable bookstand of the present disclosure from a front side.
Figure 5:
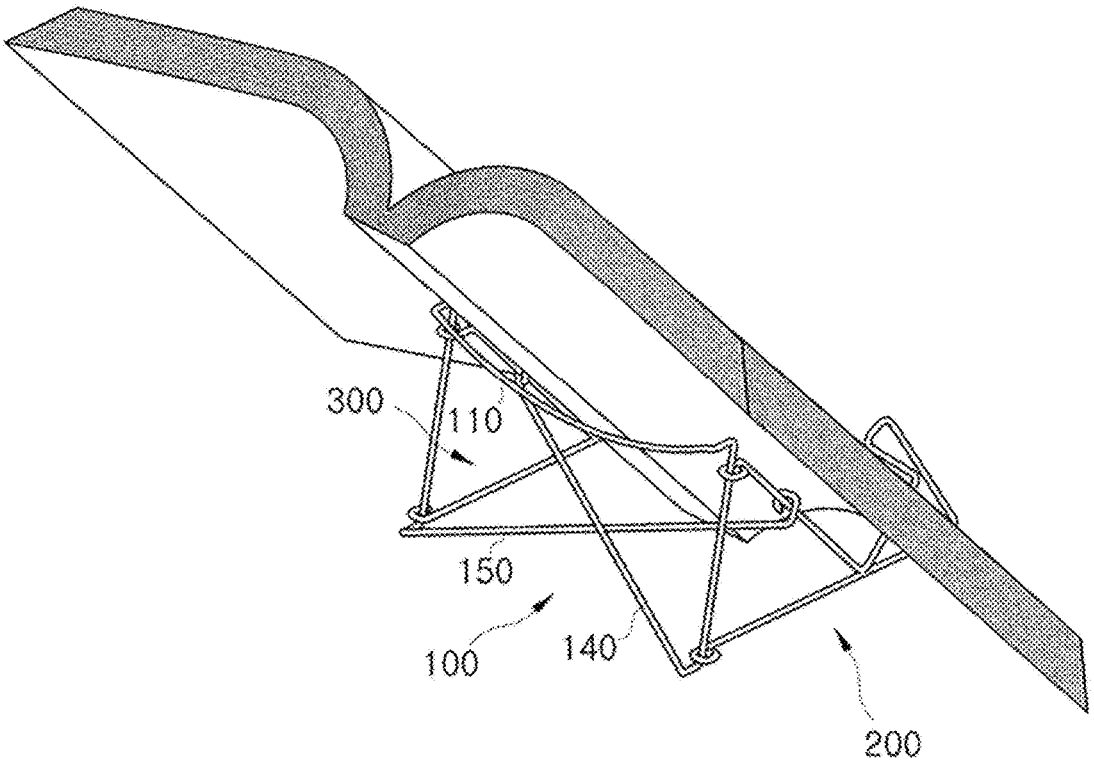
FIG. 5 is an example view illustrating a state in which a book is mounted on the portable bookstand of the present disclosure from a rear side.

That is, the book back support frame 100 is configured to support the back of a book mounted on the portable bookstand of the present disclosure from the lower side while standing on the ground. As illustrated in FIGS. 4 and 5, the lower end of the back of the book mounted on the portable bookstand is supported on the ground, and a point of the back of the book located at a predetermined height from the ground is supported by the book back support frame 100.

Figure 2:
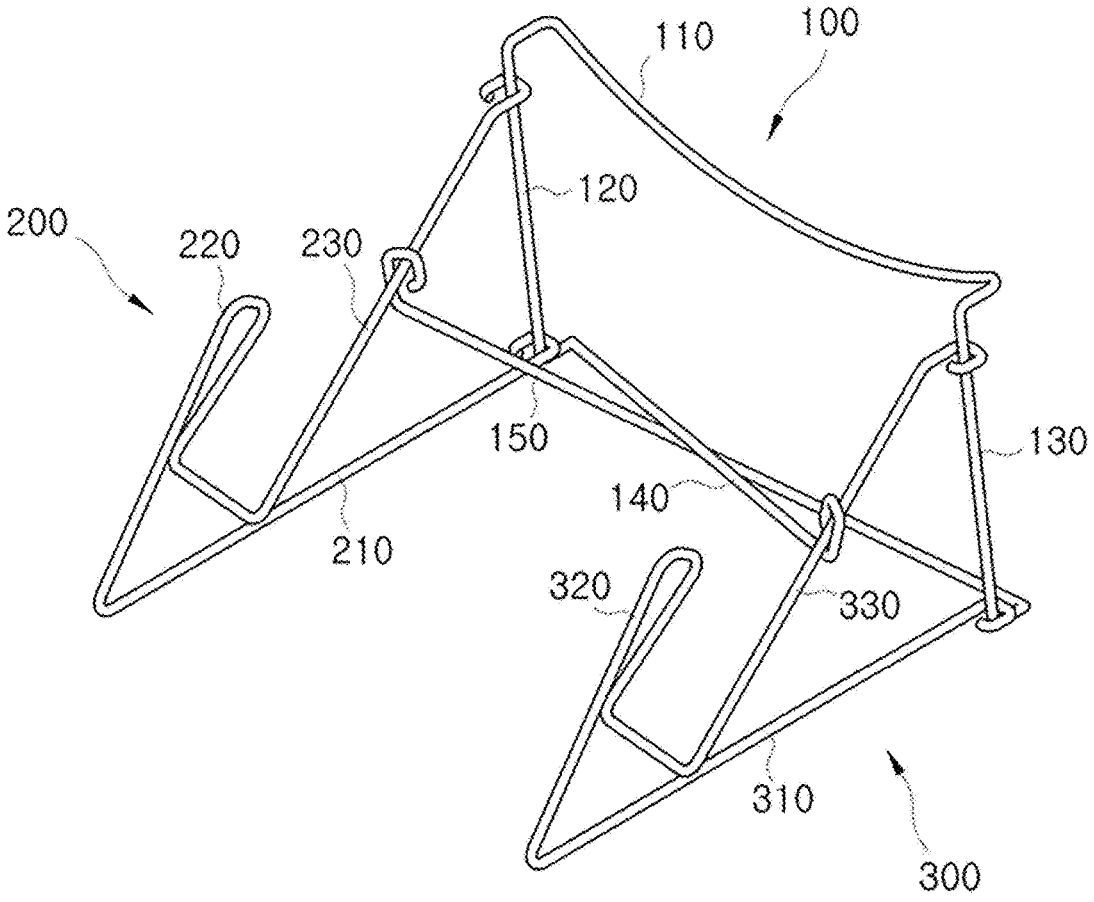
FIG. 2 is a front perspective view illustrating a portable bookstand of the present disclosure.
Figure 3:
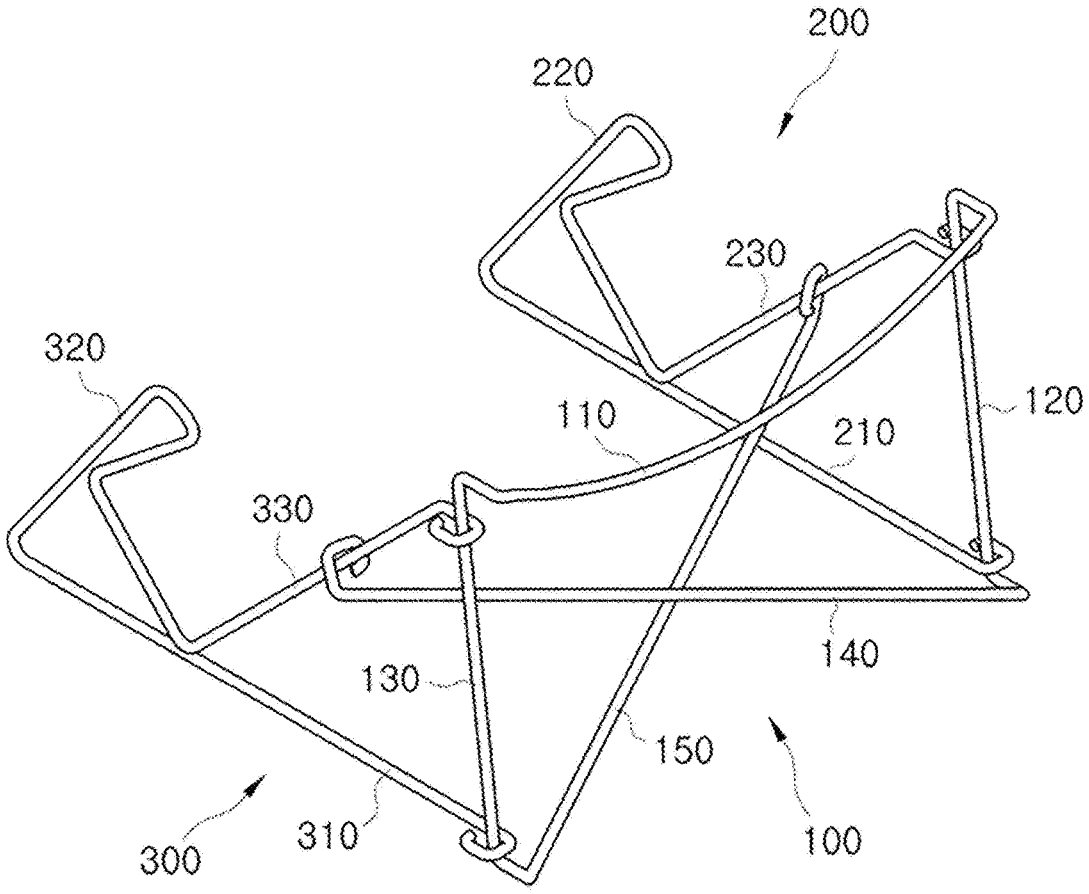
FIG. 3 is a rear perspective view illustrating the portable bookstand of the present disclosure.

Specifically, as illustrated in FIGS. 2 and 3, the book back support frame 100 may include a supporting wire 110, a first coupling wire 120, a second coupling wire 130, a first support wire 140, and a second support wire 150.

The supporting wire 110 is a part that is arranged laterally at a predetermined height to support the back of a book, and may be formed to have the shape of a straight line. However, when there is difference between the thickness of a first side of an opened book and the thickness of a second side thereof in the process of a user reading the book, the back of the book is required to be moved so that the book with different centers of gravity on the opposite sides thereof is balanced and pages of the book are inhibited from flipping. The supporting wire 110 is preferably formed to be concave downward so that the back of the book can be easily moved along the supporting wire 110.

The first coupling wire 120 is formed by extending downward from a first end of the supporting wire 110 and is a part to which the first page fixing frame 200 is rotatably coupled. The first coupling wire 120 is arranged to stand on the ground in a straight line, and may be arranged so that an upper end of the first coupling wire 120 is tilted by about 10 to 20 degrees forward relative to a lower end thereof.

The second coupling wire 130 is formed by extending downward from a second end of the supporting wire 110, is a part to which the second page fixing frame 300 is rotatably coupled, and is formed/arranged to correspond to the first coupling wire 130 described above. Accordingly, the second coupling wire 130 is arranged to stand on the ground in a straight line, and may be arranged so that an upper end of the second coupling wire 130 is tilted by about 10 to 20 degrees forward relative to a lower end thereof.

The first support wire 140, together with the second support wire 150 to be described later, forms the 'X'-shaped truss structure and is a part which securely supports a book leaning against the first page fixing frame 200 and the second page fixing frame 300. The first support wire 140 is formed by extending toward the second page fixing frame 300 from the lower end of the first coupling wire 120, wherein an upper end of the first support wire 140 is coupled to the second page fixing frame 300. In this case, the upper end of the first support wire 140 may be removably coupled to the second page fixing frame 300. For example, the upper end of the first support wire 140 may be rolled from the outside to the inside to have an entrance through which wire of which the second page fixing frame 300 is made can enter and exit. Accordingly, since the upper end of the first support wire 140 can be removed from the second page fixing frame 300, the second page fixing frame 300 may be rotated toward the book back support frame 100 so that the portable bookstand of the present disclosure is folded.

The second support wire 150, together with the first support wire 140 described above, forms the 'X'-shaped truss structure and is a part which securely supports a book leaning against the first page fixing frame 200 and the second page fixing frame 300. The second support wire 150 is formed by extending toward the first page fixing frame 200 from the lower end of the second coupling wire 130, wherein an upper end of the second support wire 150 is coupled to the first page fixing frame 200. In this case, the upper end of the second support wire 150 may be removably coupled to the first page fixing frame 200. For example, the upper end of the second support wire 150 may be rolled from the outside to the inside to have an entrance through which wire of which the first page fixing frame 200 is made can enter and exit. Accordingly, since the upper end of the second support wire 150 can be removed from the first page fixing frame 200, the first page fixing frame 200 may be rotated toward the book back support frame 100 so that the portable bookstand of the present disclosure is folded.

As described above, the book back support frame 100 forms the 'X'-shaped truss structure in such a manner that the first support wire 140 and the second support wire 150 are respectively coupled to the second page fixing frame 300 and the first page fixing frame 200. That is, as illustrated in FIGS. 4 and 5, in the portable bookstand of the present disclosure, while the first page fixing frame 200 and the second page fixing frame 300 are arranged to face forward, the upper ends of the truss structure (the upper end of the first support wire 140 and the upper end of the second support wire 150) are respectively coupled to the second page fixing frame 300 and the first page fixing frame 200 arranged to face forward, so the 'X'-shaped truss structure of the book back support frame 100 securely supports a book.

Meanwhile, in the portable bookstand of the present disclosure, the first page fixing frame 200 and the second page fixing frame 300 may be rotated without interfering with the book back support frame 100, and may be configured to have minimal volume when folded so that the first page fixing frame 200 and the second page fixing frame 300 rotated toward the book back support frame 100 can be located inside a predetermined space.

As an example for this, as illustrated in FIGS. 2 and 3, the opposite ends of the supporting wire 110 bend to protrude by predetermined lengths forward, and the lower end of the first support wire 140 and the lower end of the second support wire 150 may bend to protrude by predetermined lengths rearward from the lower end of the first coupling wire 120 and the lower end of the second coupling wire 130, respectively.

Accordingly, the upper end of the first coupling wire 120 and the upper end of the second coupling wire 130 are located ahead of a remaining part except for the opposite ends of the supporting wire 110, and the lower end of the first coupling wire 120 and the lower end of the second coupling wire 130 are located ahead of a point at which the first support wire 140 extends upward and a point at which the second support wire 150 extends upward so as to define a predetermined space.

Accordingly, the first page fixing frame 200 and the second page fixing frame 300 are respectively coupled to the first coupling wire 120 and the second coupling wire 130 located ahead of the predetermined space, and do not interfere with the supporting wire 110 arranged laterally, the first support wire 140, and the second support wire 150 when the first page fixing frame 200 and the second page fixing frame 300 are folded.

Figure 6:
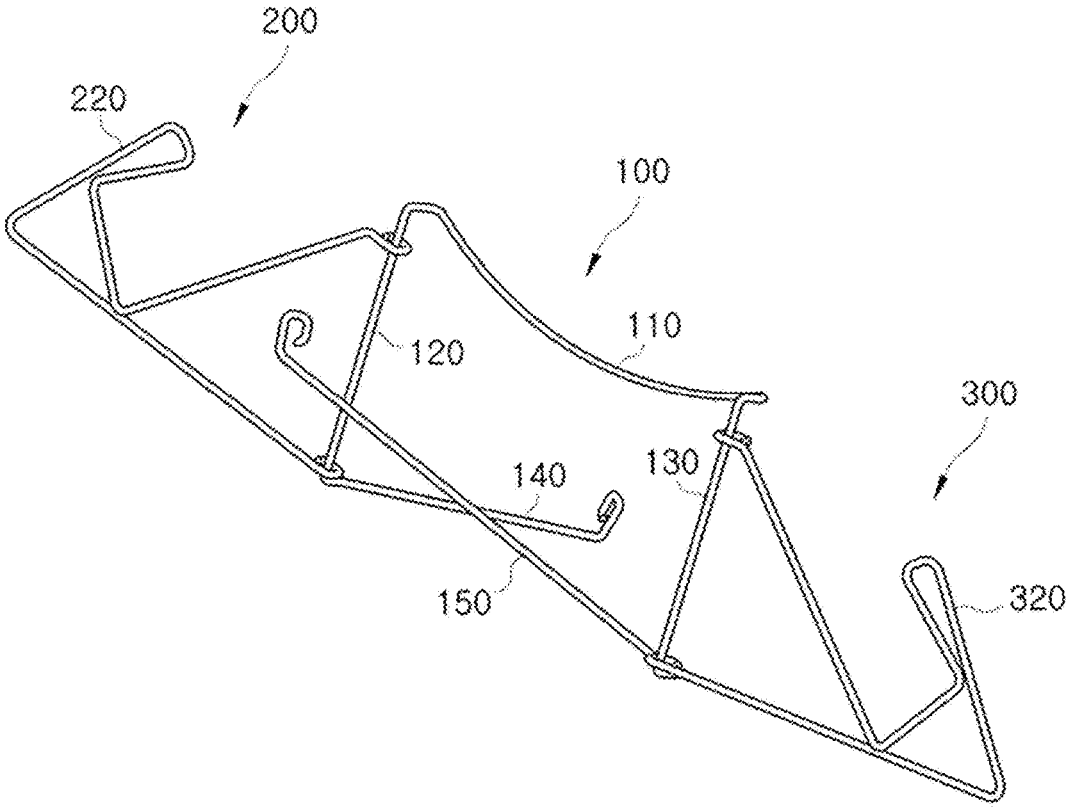
FIG. 6 is a perspective view illustrating a state in which the portable bookstand of the present disclosure is unfolded.

In addition, the first page fixing frame 200 and the second page fixing frame 300 can be folded to be located within the predetermined space. As a specific example, when the use of the portable bookstand is completed, the upper end of the first support wire 140 and the upper end of the second support wire 150 are respectively removed from the second page fixing frame 300 and the first page fixing frame 200, so the first page fixing frame 200 and the second page fixing frame 300 may be unfolded as illustrated in FIG. 6. In this case, the upper end of the first support wire 140 and the upper end of the second support wire 150 which have been removed protrude forward compared to other components.

Figure 7:
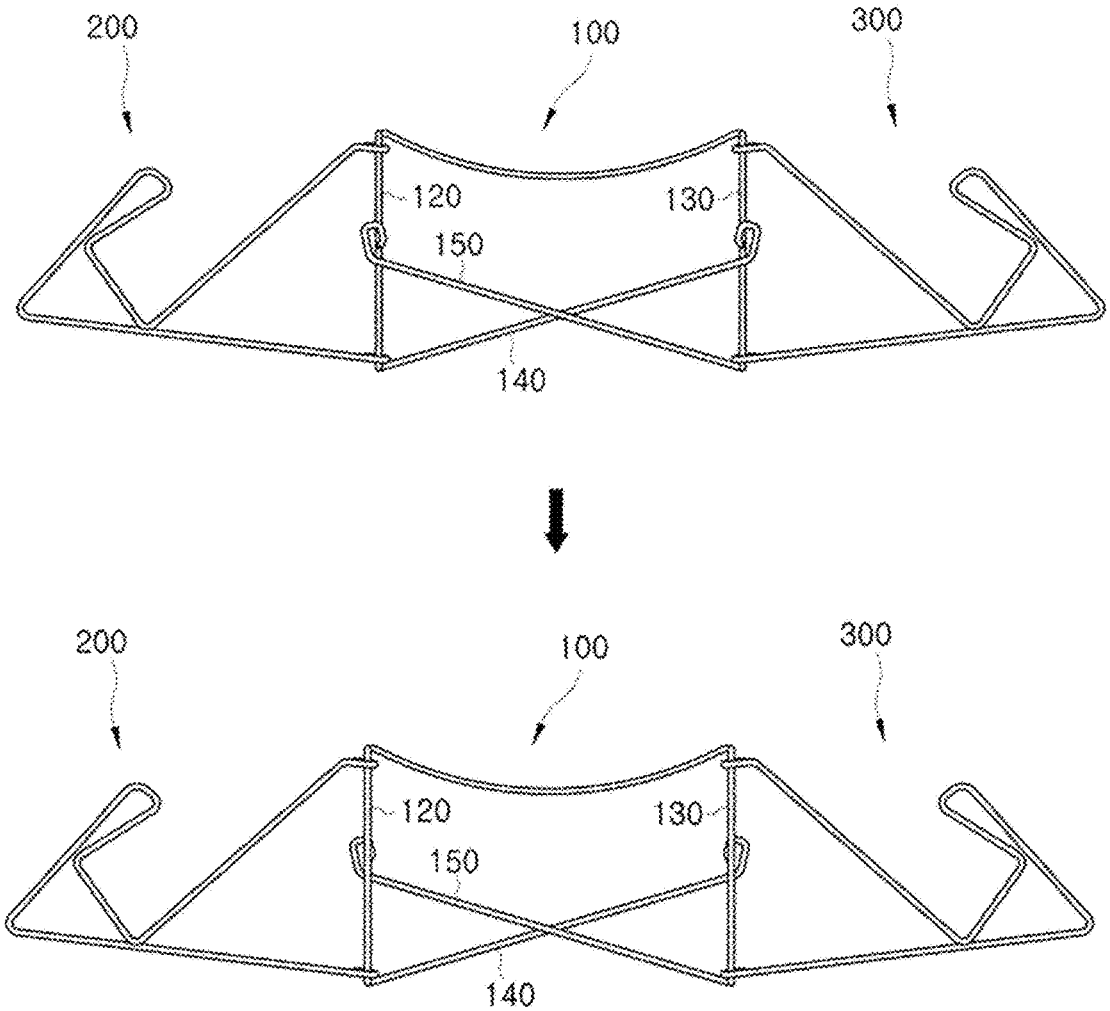
FIG. 7 is an example view illustrating a state in which the upper end of a first support wire and the upper end of a second support wire applied to the portable bookstand of the present disclosure are respectively located on the rears of a second coupling wire and a first coupling wire.

Next, as illustrated in FIG. 7, in the portable bookstand made of elastic wires, after a distance between the first coupling wire 120 and the second coupling wire 130 is slightly increased, the upper end of the first support wire 140 and the upper end of the second support wire 150 are respectively located at the rear of the second coupling wire 130 and the rear of the first coupling wire 120 so that the upper end of the first support wire 140 and the upper end of the second support wire 150 can be fixed so as not to protrude forward compared to other components.

Figure 8:
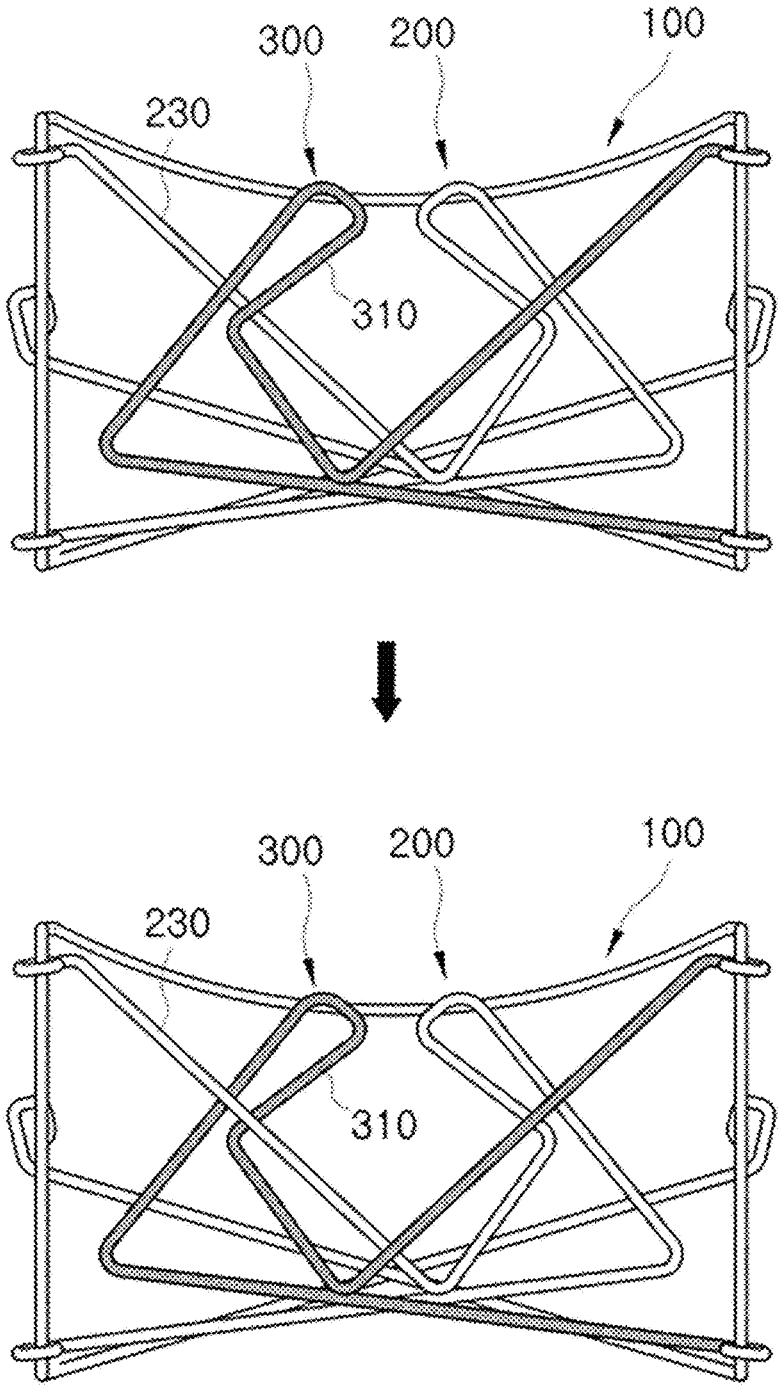
FIG. 8 is an example view illustrating a state in which a first page fixing frame and a second page fixing frame applied to the portable bookstand of the present disclosure are folded inward to cross with each other.

Next, as illustrated in FIG. 8, the first page fixing frame 200 and the second page fixing frame 300 are folded inward, and an outer component of the first page fixing frame 200 and the second page fixing frame 300 is inserted into an inner component thereof so that the outer and inner components overlap each other, so the first page fixing frame 200 and the second page fixing frame 300 can be fixed to be located within the predetermined space without being rotated.

Figure 9:
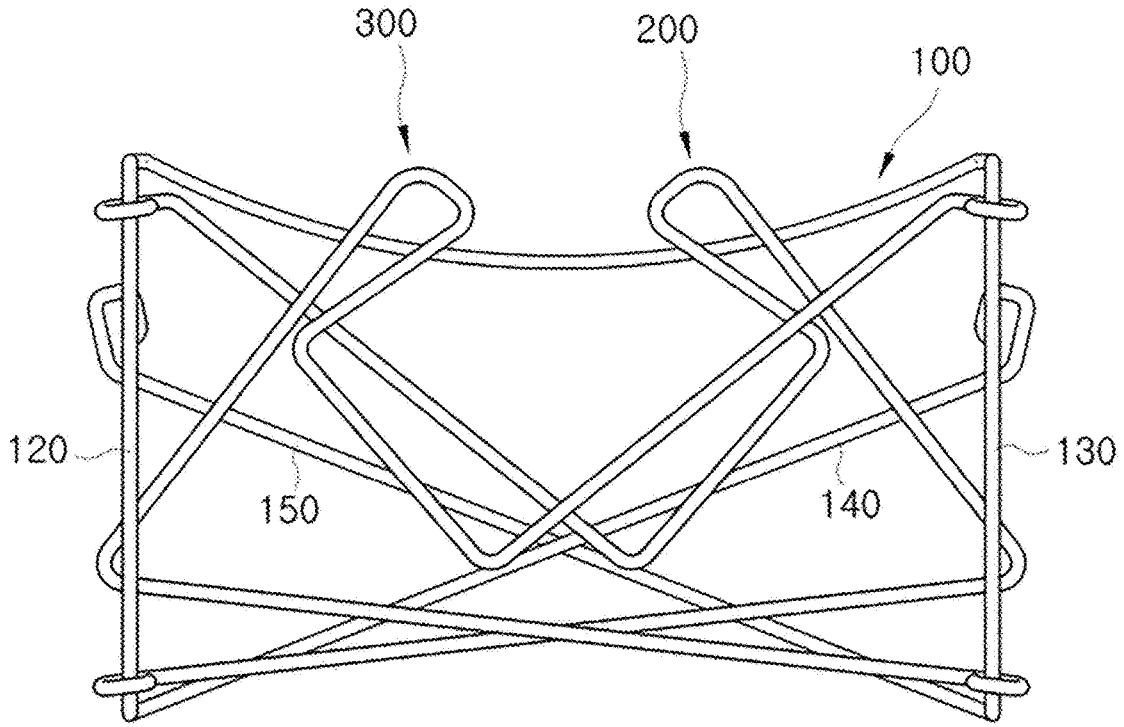
FIG. 9 is an example view illustrating a state in which the first page fixing frame and the second page fixing frame applied to the portable bookstand of the present disclosure are folded inward so that the outermost parts of the first page fixing frame and the second page fixing frame are respectively located and fixed on the rears of the second coupling wire and the first coupling wire.

Alternatively, as illustrated in FIG. 9, after the first page fixing frame 200 and the second page fixing frame 300 are folded inward, the outermost part of the first page fixing frame 200 adjacent to the second coupling wire 130 is held to be located on the rear of the second coupling wire 130, and the outermost part of the second page fixing frame 300 adjacent to the first coupling wire 120 is held to be located on the rear of the first coupling wire 120, so the first page fixing frame 200 and the second page fixing frame 300 can be fixed to be located within the predetermined space without being rotated.

Due to this foldable structure, the portable bookstand of the present disclosure is lightweight and small in size, so the portable bookstand can be placed between pages of a book or in a book pouch with the book, thereby making it easy to carry the portable bookstand.

Meanwhile, the first page fixing frame 200 is configured to allow a page located on a first side of a mounted book to lean against the first page fixing frame and to fix the page. For example, the first page fixing frame 200 may be formed by bending one piece of wire to include a support part 210 placed on the ground, a fixing part 220 formed by extending from the support part 210 and configured to press a page of a book in front of the page, and a mounting part 230 formed by extending from the fixing part 220 and configured so that the book is seated on the mounting part and a page of the book leans against the mounting part.

Specifically, the support part 210 may be formed to have the shape of a straight line and may have a first end formed in a ring shape to be rotatable to the first coupling wire 120 coupled thereto. In describing the fixing part 220 and the mounting part 230 below, the description will be made on the premise that the first page fixing frame 200 is arranged and erected in a front to rear direction.

The fixing part 220 is formed to be inclined upward toward a rear side between the second end of the support part 210, on which the first end of the fixing part 220 is located, and a first point, and extends from the first point to be formed to be inclined downward toward a front side between the first point and a second point at the rear side of the upward inclining part. In this case, a part of the fixing part 220 between the first point and the second point is formed to be more inclined than the remaining part, and a second end of the part is formed to be adjacent to a part of the fixing part 220 between the second end of the support part 210 and the first point so that the fixing part 220 is secured.

The mounting part 230 is formed to be inclined downward toward the rear side between the second end of the fixing part 220, on which the first end of the mounting part 230 is located, and a point adjacent to the support part 210, and extends to be formed to be inclined upward toward the rear side at a rear side of the downward inclining part. In this case, the second end of the mounting part 230 may be formed to be located higher than the first point of the fixing part 220 and may be formed in a ring shape to be rotatable to the first coupling wire 120 coupled thereto. In the mounting part 230, a book is seated on the downward inclining part toward the rear side, and pages of the seated book lean against the upward inclining part toward the rear side.

In the first page fixing frame 200 having the above-described structure, the part between the first point and second point of the fixing part 220 may be formed to be parallel with the upward inclining part of the mounting part 230, but it is preferable that in order to improve the fixing power of pages by the fixing part 220, a width between the part between the first point and second point of the fixing part 220 and the upward inclining part of the mounting part 230 is gradually decreased upward.

The second page fixing frame 300 is configured to allow a page of a book located on a second side of the mounted book to lean against the second page fixing frame and to fix the page. For example, the second page fixing frame 300 may be formed by bending one piece of wire to include a support part 310 placed on the ground, a fixing part 320 formed by extending from the support part 310 and configured to press a page of a book in front of the page, and a mounting part 330 formed by extending from the fixing part 320 and configured so that the book is seated on the mounting part and a page of the book leans against the mounting part.

The support part 310, the fixing part 320, and the mounting part 330 constituting the second page fixing frame 300 have the same structure as the structure of the support part 210, the fixing part 220, and the mounting part 330 constituting the first page fixing frame 200, and thus detailed description thereof is omitted.

The first page fixing frame 200 and the second page fixing frame 300 inhibit pages of a book from flipping arbitrarily, so through the portable bookstand of the present disclosure, a user can enjoy reading a book while the book is stably mounted.

<Description of the Reference Numerals in the Drawings>

| | |
|---|---|
| 100: Book back support frame | 110: Supporting wire |
| 120: First coupling wire | 130: Second coupling wire |
| 140: First support wire | 150: Second support wire |
| 200: First page fixing frame | 210: Support part |
| 220: Fixing part | 230: Mounting part |
| 300: Second page fixing frame | 310: Support part |
| 320: Fixing part | 330: Mounting part |

The invention claimed is:

1. A portable bookstand comprising:

a book back support frame (100) configured to support a back of a book;

a first page fixing frame (200) coupled rotatably to a first side of the book back support frame (100) and configured to fix a page of the book while supporting a first side of the book; and a second page fixing frame (300) coupled rotatably to a second side of the book back support frame (100) and configured to fix a page of the book while supporting a second side of the book, wherein the book back support frame (100), the first page fixing frame (200), and the second page fixing frame (300) are formed by bending wires, and the book back support frame (100) comprises an 'X'-shaped truss structure, with upper ends of the truss structure being respectively coupled to the first page fixing frame (200) and the second page fixing frame (300) when they are disposed to face forward;

wherein the book back support frame (100) comprises:

a supporting wire (110) configured to support the back of a book, a first coupling wire (120) formed by extending downward from a first end of the supporting wire (110), with the first page fixing frame (200) being coupled to the first coupling wire (120), a second coupling wire (130) formed by extending downward from a second end of the supporting wire (110), with the second page fixing frame (300) being coupled to the second coupling wire (130), a first support wire (140) formed by extending from a lower end of the first coupling wire (120) toward the second page fixing frame (300), with an upper end of the first support wire (140) being removably coupled to the second page fixing frame (300), and a second support wire (150) formed by extending from a lower end of the second coupling wire (130) toward the first page fixing frame (200), with an upper end of the second support wire (150) being removably coupled to the first page fixing frame (200);

wherein opposite ends of the supporting wire (110) bend to protrude by predetermined lengths forward, and wherein a lower end of the first support wire (140) and a lower end of the second support wire (150) bend to protrude by predetermined lengths rearward from the lower end of the first coupling wire (120) and the lower end of the second coupling wire (130), respectively.

2. The portable bookstand of claim 1, wherein the book back support frame (100), the first page fixing frame (200), and the second page fixing frame (300) are formed of elastic wires, and the upper end of the first support wire (140) and the upper end of the second support wire (150) are respectively removed from the second page fixing frame (300) and the first page fixing frame (200) to be located on rears of the second coupling wire (130) and the first coupling wire (120), and the first page fixing frame (200) and the second page fixing frame (300) are folded inward so that outermost parts of the first page fixing frame (200) and the second page fixing frame (300) adjacent to the second coupling wire (130) and the first coupling wire (120), respectively, are held to be located on the rears of the second coupling wire (130) and the first coupling wire (120), respectively.

3. The portable bookstand of claim 1, wherein the supporting wire (110) is formed to be concave downward.

4. A portable bookstand comprising:

a book back support frame (100) configured to support a back of a book;

a first page fixing frame (200) coupled rotatably to a first side of the book back support frame (100) and configured to fix a page of the book while supporting a first side of the book; and a second page fixing frame (300) coupled rotatably to a second side of the book back support frame (100) and configured to fix a page of the book while supporting a second side of the book, wherein the book back support frame (100), the first page fixing frame (200), and the second page fixing frame (300) are formed by bending wires, and the book back support frame (100) comprises an 'X'-shaped truss structure, with upper ends of the truss structure being respectively coupled to the first page fixing frame (200) and the second page fixing frame (300) when they are disposed to face forward;

wherein the book back support frame (100) comprises:

a supporting wire (110) configured to support the back of a book, a first coupling wire (120) formed by extending downward from a first end of the supporting wire (110), with the first page fixing frame (200) being coupled to the first coupling wire (120), a second coupling wire (130) formed by extending downward from a second end of the supporting wire (110), with the second page fixing frame (300) being coupled to the second coupling wire (130), a first support wire (140) formed by extending from a lower end of the first coupling wire (120) toward the second page fixing frame (300), with an upper end of the first support wire (140) being removably coupled to the second page fixing frame (300), and a second support wire (150) formed by extending from a lower end of the second coupling wire (130) toward the first page fixing frame (200), with an upper end of the second support wire (150) being removably coupled to the first page fixing frame (200);

wherein the book back support frame (100), the first page fixing frame (200), and the second page fixing frame (300) are formed of elastic wires, and the upper end of the first support wire (140) and the upper end of the second support wire (150) are respectively removed from the second page fixing frame (300) and the first page fixing frame (200) to be located on rears of the second coupling wire (130) and the first coupling wire (120), and the first page fixing frame (200) and the second page fixing frame (300) are folded inward so that outermost parts of the first page fixing frame (200) and the second page fixing frame (300) adjacent to the second coupling wire (130) and the first coupling wire (120), respectively, are held to be located on the rears of the second coupling wire (130) and the first coupling wire (120), respectively.

5. The portable bookstand of claim 4, wherein the supporting wire (110) is formed to be concave downward.

* * * * *